US007270253B2

(12) United States Patent
Radke et al.

(10) Patent No.: US 7,270,253 B2
(45) Date of Patent: Sep. 18, 2007

(54) HOSIERY REMOVER AND METHOD OF REMOVING HOSIERY

(76) Inventors: Ethel Radke, 4339 Sunridge Dr., Apt. R, St. Louis, MO (US) 63125; Eugene Bollefer, 1402 Beanehaven La., Godfrey, IL (US) 62035; Barbara L. Bollefer, 1402 Beanehaven La., Godfrey, IL (US) 62035

( * ) Notice: Subject to any disclaimer, the term of this patent is extended or adjusted under 35 U.S.C. 154(b) by 0 days.

(21) Appl. No.: 11/253,414

(22) Filed: Oct. 19, 2005

(65) Prior Publication Data

US 2006/0249551 A1 Nov. 9, 2006

Related U.S. Application Data

(60) Provisional application No. 60/678,845, filed on May 6, 2005.

(51) Int. Cl.
*A47G 25/90* (2006.01)

(52) U.S. Cl. ..... 223/112

(58) Field of Classification Search ..... 223/1, 223/111–119

See application file for complete search history.

(56) References Cited

U.S. PATENT DOCUMENTS

| | | | | |
|---|---|---|---|---|
| 2,443,115 | A * | 6/1948 | Park | 223/111 |
| 2,796,207 | A * | 6/1957 | Young | 223/111 |
| 3,070,271 | A * | 12/1962 | Kennedy, Sr. | 223/111 |
| 4,072,255 | A | 2/1978 | Bogorad | |
| 4,638,932 | A | 1/1987 | Keller | |
| 5,069,374 | A * | 12/1991 | Williamson et al. | 223/111 |
| 5,974,701 | A * | 11/1999 | Busch | 36/138 |
| 6,508,496 | B1 * | 1/2003 | Huang | 294/19.1 |
| 2006/0027612 | A1 * | 2/2006 | Boaron | 223/111 |

* cited by examiner

*Primary Examiner*—Gary L. Welch
*Assistant Examiner*—Andrew W Sutton
(74) *Attorney, Agent, or Firm*—Senniger Powers

(57) ABSTRACT

An apparatus for removing hosiery from a leg of a wearer, the hosiery includes a tubular body with a foot end and an open end for receiving the wearer's foot and at least a portion of the wearer's leg. The apparatus comprises a sliding surface and a strap engaging the sliding surface. The strap includes a first end having at least one connector for connection to the hosiery and a second end forming a handle to be grasped by the wearer. The strap is free of objects along its length such that the strap can slide uninhibited over the sliding surface.

16 Claims, 10 Drawing Sheets

HOSIERY REMOVER AND METHOD OF REMOVING HOSIERY

CROSS-REFERENCE TO RELATED APPLICATIONS

This application is a non-provisional of U.S. Provisional Application Ser. No. 60/678,845, filed May 6, 2005, which is hereby incorporated by reference.

BACKGROUND OF THE INVENTION

The present invention relates generally to apparel apparatus and related methods, and more particularly to an apparatus and method for removing hosiery from a leg of a wearer.

Hosiery are difficult to remove for individuals who have a limited range of movement and in particular those who have difficulty bending at the waist. Many people find it difficult to bend and remove hosiery from their legs, including the elderly, the obese, the disabled, the arthritic, orthopedic patients, and pregnant women experiencing difficulties.

Compression stockings, one example of hosiery, are worn as treatment or prevention for a variety of ailments or conditions including, but not limited to, varicose veins, edema, or post-surgery to improve the flow of blood in the legs. Those who have difficulty removing a compression stocking often have to arrange to have another individual remove the stocking each evening before going to bed. This may become expensive, embarrassing, or cumbersome for the person wearing the compression stocking.

SUMMARY OF THE INVENTION

In one aspect, the invention is directed to an apparatus for removing hosiery from a leg of a wearer. The hosiery includes a tubular body with a foot end and an open end for receiving the wearer's foot and at least a portion of the wearer's leg. The apparatus comprises a sliding surface and a strap engaging the sliding surface. The strap includes a first end having at least one connector for connection to the hosiery and a second end forming a handle to be grasped by the wearer. The strap is free of objects along its length such that the strap can slide uninhibited over the sliding surface.

Another aspect is directed to an apparatus for removing hosiery from a leg of a wearer. The apparatus comprises an elongate strap including a first end having at least one connector for attaching the strap to the hosiery and a second end forming a handle for grasping by the wearer. A sliding surface is slidingly engaged by the strap. The strap is looped over the sliding surface such that the at least one connector at the first end of the strap can be attached to the hosiery and the handle at the second end is available for grasping by the wearer. The strap is free of objects along its length such that the strap can slide uninhibited over the sliding surface.

Yet another aspect is directed to a method of removing hosiery from a leg of a wearer using an apparatus. The apparatus includes an elongate strap having a first end and a second end, a remotely fixed sliding surface, and at least one connector located at the first end of the strap. The method comprises attaching the at least one connector to the hosiery, and positioning the strap over the remotely fixed sliding surface such that a portion of the strap is positioned beneath the sliding surface and a portion of the strap is positioned over the sliding surface. Other step of the method include grasping the second end of the strap, and applying a force to the grasped strap to pull the stocking off the leg of the wearer.

Various refinements exist of the features noted in relation to the above-mentioned aspects of the present invention. Further features may also be incorporated in the above-mentioned aspects of the present invention as well. These refinements and additional features may exist individually or in any combination. For instance, various features discussed below in relation to any of the illustrated embodiments of the present invention may be incorporated into any of the above-described aspects of the present invention, alone or in any combination.

Other features will be in part apparent and in part pointed out hereinafter.

BRIEF DESCRIPTION OF THE DRAWINGS

Corresponding reference characters indicate corresponding parts throughout the drawings.

DETAILED DESCRIPTION OF CONFIGURATIONS

Figure 1:
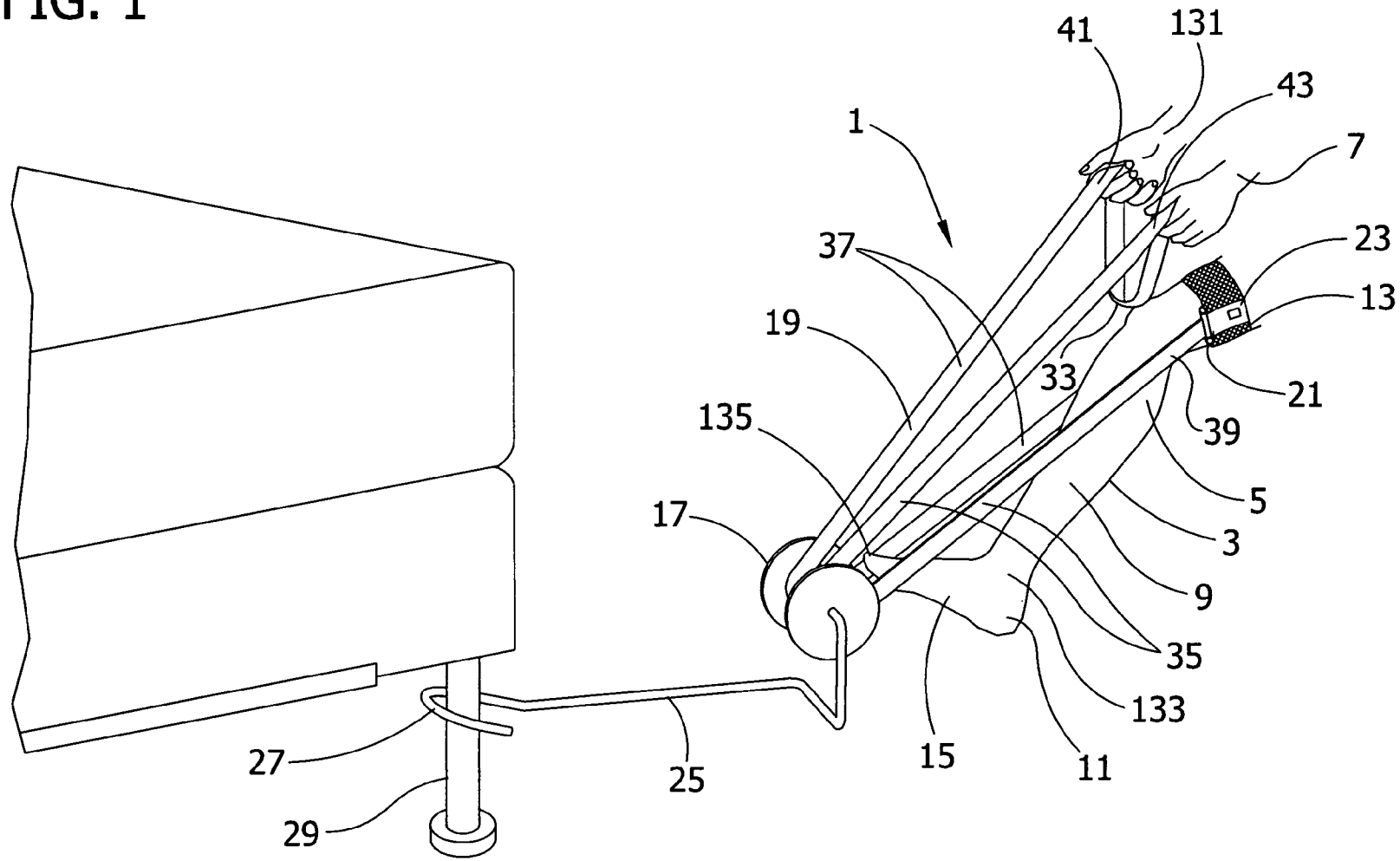
FIG. 1 is a perspective view of one configuration of an apparatus for removing hosiery.
Figure 4A:
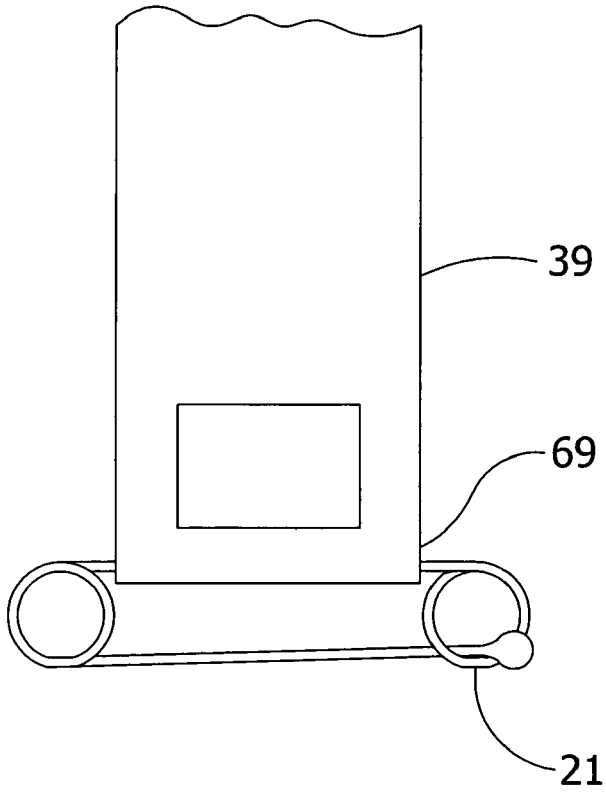
FIG. 4A is a fragmentary elevation of an end of an elongate strap of the apparatus of FIG. 1.
Figure 4B:
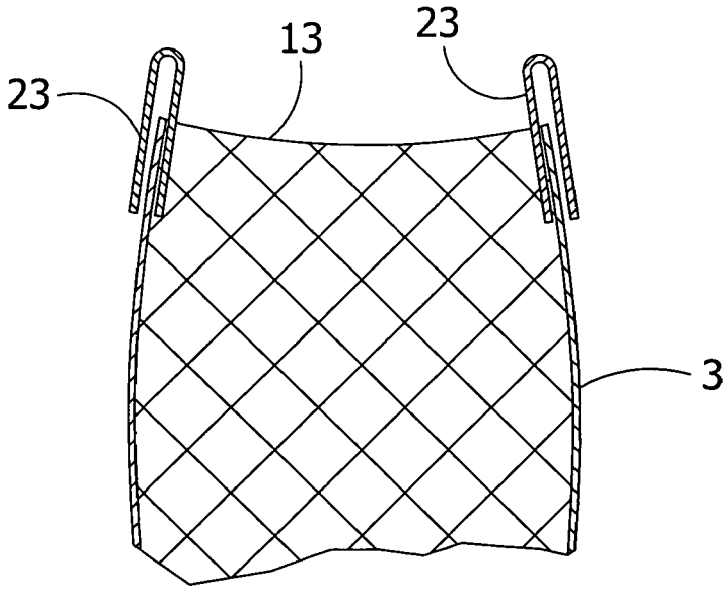
FIG. 4B is a fragmentary section view of an open end of the hosiery showing two loops connected to opposite sides of the hosiery.
Figure 4C:
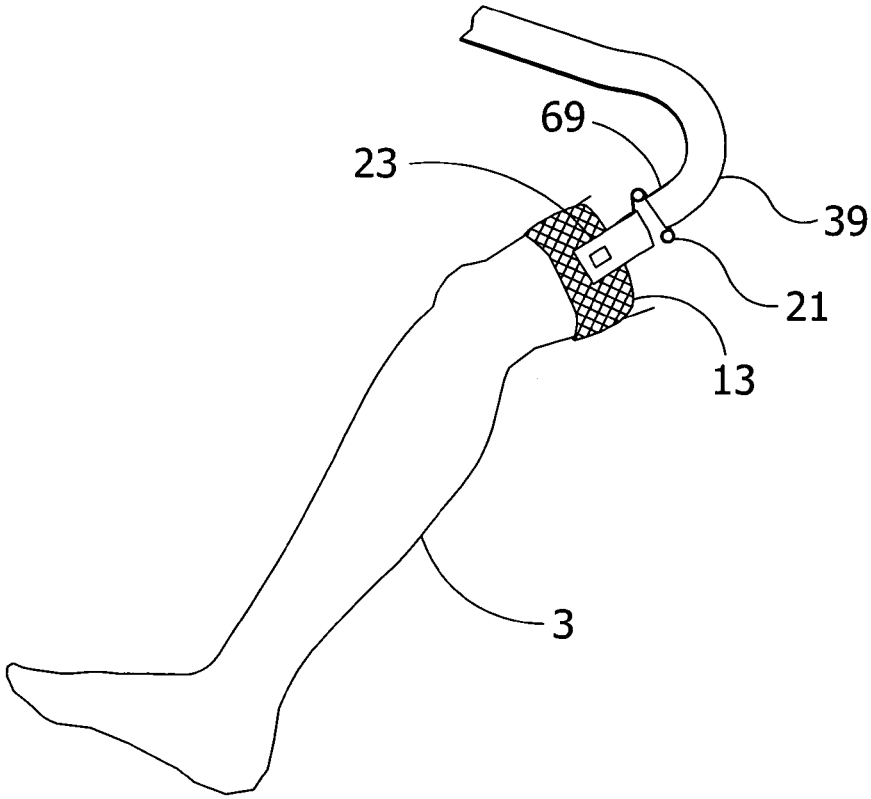
FIG. 4C is a perspective view of the strap partially connected to the loop on an open end of the hosiery.

Referring now to the drawings and in particular to FIG. 1, an apparatus of one configuration for removing hosiery 3 from a leg 5 of a wearer 7 is designated in its entirety by the reference numeral 1. The hosiery 3 has a tubular body 9 with a foot end 11 and an open end 13 for receiving a foot 15 of the wearer 7 and at least a portion of the leg 5 of the wearer 7. The hosiery 3 may be a compression stocking, but other types of hosiery are within the scope of the invention. The apparatus 1 comprises a pulley 17 (broadly, "sliding surface"), an elongate strap 19 engaging the pulley 17, at least one locking fastener 21 (broadly, "connector"), loops 23 attached on opposite sides of the hosiery 3 adjacent the open end 13 (FIGS. 4B & 4D), and an anchor 25 for holding the pulley 17. The anchor 25 has a hook 27 which can, for example, be used to secure the apparatus 1 to a furniture leg 29, e.g., a bed leg, when in use. The hook 27 may be sheathed in a soft material (not shown) to protect the furniture leg 29 from damage when engaged by the hook 27.

As shown in FIG. 1, the strap 19 of this configuration is a single piece of material with a length greater than about four times the length of the hosiery 3. The strap 19 has a generally rectangular cross-section such that a width of the strap 19 is much greater than a height of the strap 19 in cross-section. The strap 19 is folded generally in half or doubled over along a fold line 33 to define a first strap portion 35 and a second strap portion 37 of approximately equal length. Each strap portion 35, 37 has a first end 39 having the locking fastener 21 secured thereto for attaching the strap 19 to the hosiery 3, and a second end 41 adjacent the fold line 33 forming a handle 43 available to be grasped by the wearer 7. The locking fastener 21 on each strap portion 35, 37 attaches to one of the loops 23 on opposite sides of the hosiery 3 adjacent the open end 13 of the hosiery 3. In the illustrated embodiment, the locking fasteners 21 are attached on opposed sides of the hosiery 3. More specifically, one of the fasteners 21 is attached to the hosiery 3 at approximately the three o'clock position and the other at the nine o'clock position (FIGS. 4C, 4D, 5A, and 6A). In another embodiment (FIG. 1), the fasteners 21 are attached to the hosiery 3 at the four o'clock and eight o'clock positions. It is understood that the fasteners 21 may be attached to hosiery 3 at other positions without departing from the scope of this invention.

As further described below, the strap 19 is looped over the pulley 17 by positioning the second end 41 of each strap portion 35, 37 beneath the pulley 17. Then the wearer 7 pulls the second end 41 of each strap portion 35, 37 over the top of the pulley 17 so the wearer 7 can grasp at least a part of each of the first and second strap portions 35, 37. To loop the strap 19 over the pulley 17, the wearer 7 may use an extension rod (not shown). The strap 19 is free of objects along its length so the strap 19 can slide smoothly and uninhibited over the pulley 17.

Figure 2A:
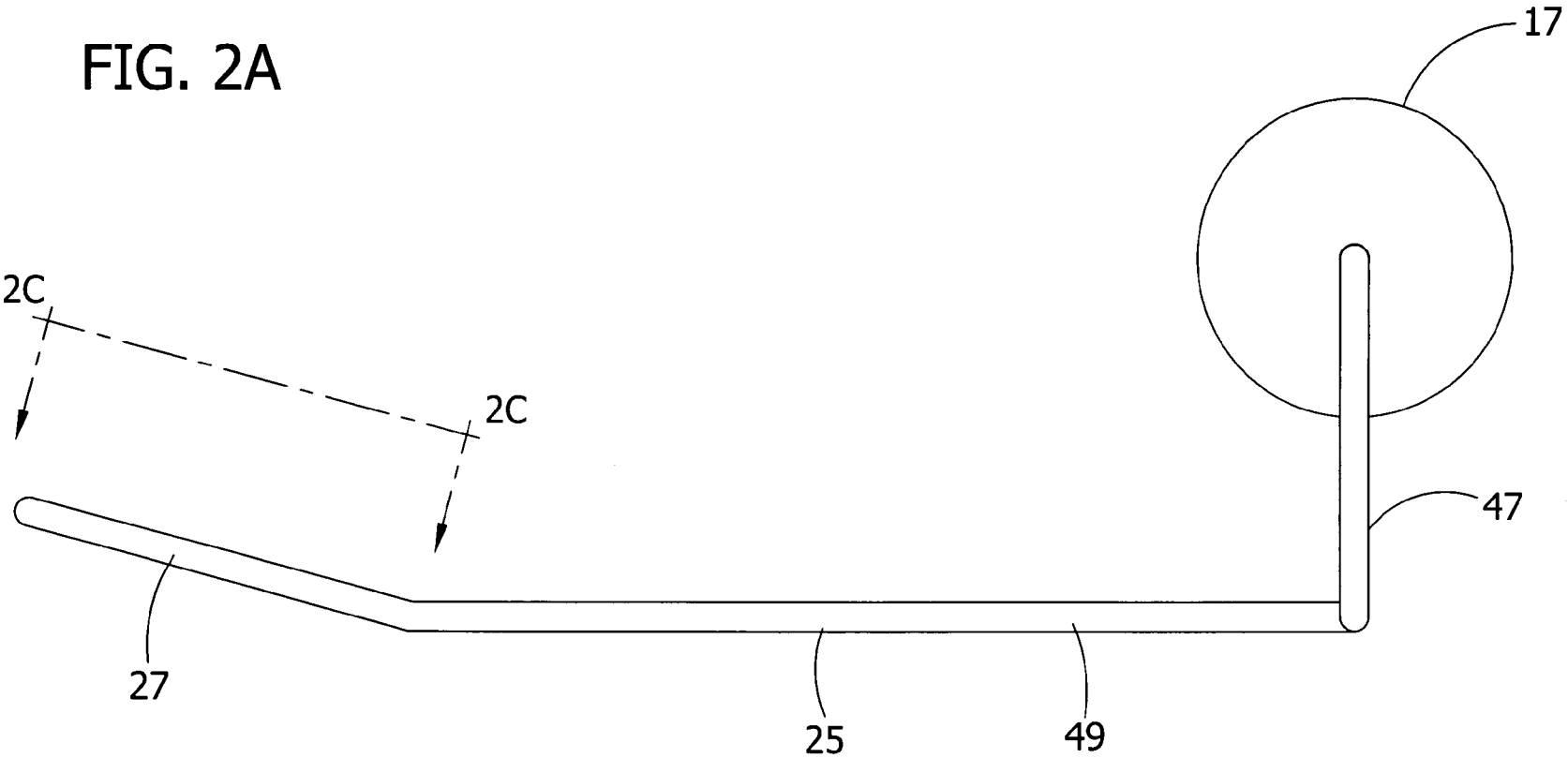
FIG. 2A is a side elevation of an anchor and pulley of the apparatus of FIG. 1.
Figure 2B:
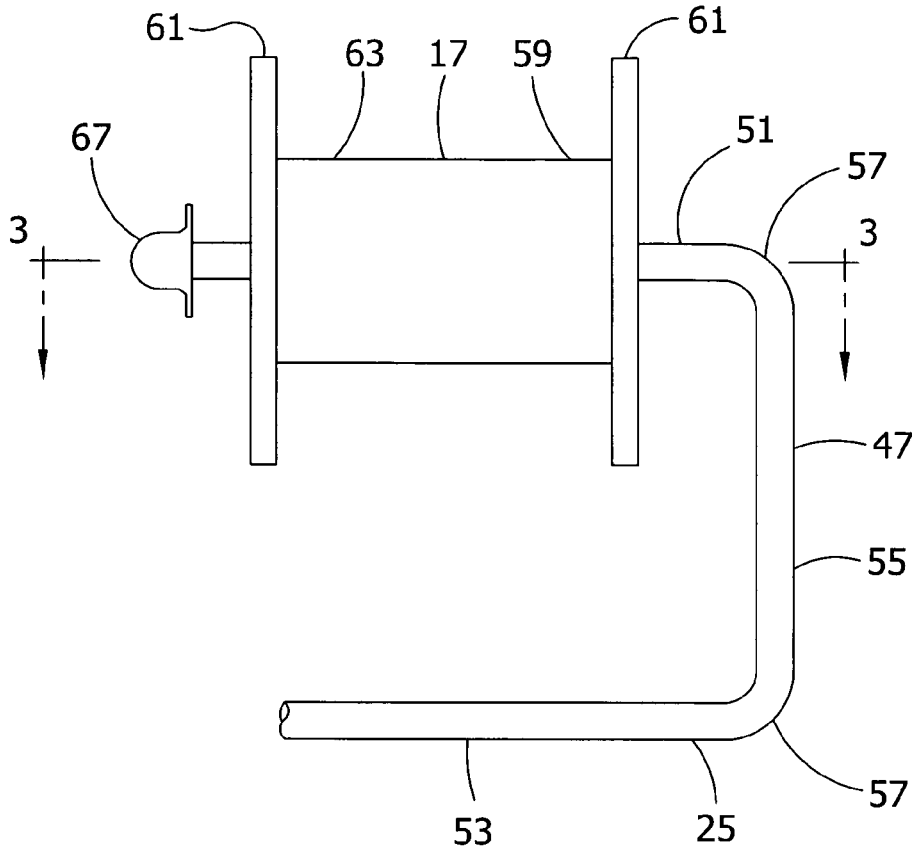
FIG. 2B is a fragmentary front elevation of the pulley showing a C-shaped portion of the anchor.
Figure 2C:
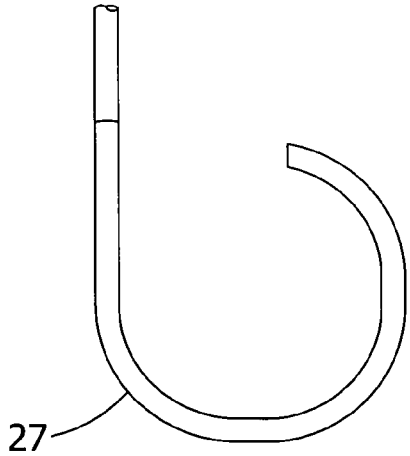
FIG. 2C is a fragmentary auxiliary view of the anchor of the apparatus taken in the plane of line 2C-2C of FIG. 2A, showing a hook at the end of the anchor.

As shown in FIGS. 2A-2C the anchor 25 comprises a C-shaped portion 47, a straight portion 49, and the hook 27. The C-shaped portion 47 has a top 51, bottom 53, and side 55 formed by two bends 57 of about 90 degrees. The straight portion 49 of the anchor 25 extends from the bottom 53 of the C-shaped portion 47 generally perpendicular from the plane defined by the C-shaped portion 47. The hook 27 extends from the straight portion 49 of the anchor 25 at an angle of about 30 degrees towards the C-shaped portion 47. The shape of the anchor 25 shown in FIGS. 2A-2C is advantageous because positioning the pulley 17 at the top 51 of the C-shaped portion 47 allows the pulley 17 to rotate while the straight portion 49 of the anchor 25 rests on the ground. Also, the C-shaped portion 47 is necessary to use the anchor 25 in the configurations shown in FIGS. 5A-6C and described below.

The anchor 25 is suitably made from a solid metal rod of circular cross-section of about 0.25 inches diameter. The hook 27 has a diameter of about 3 inches and an opening of about 2 inches. The straight portion 49 of the anchor 25 has a length of about 12 inches. The top 51 of the C-shaped portion 47 has a length of about 4.5 inches. The bottom 53 of the C-shaped portion 47 has a length of about 4.5 inches. The side 55 of the C-shaped portion 47 has a length of about 6 inches. From a side view the overall length of the anchor 25 is about 18 inches. The dimensions provided herein are for exemplary purposes only and it is understood that the anchor 25 can have other dimensions without departing from the scope of this invention. It is also understood that the anchor 25 may be made from materials besides metal (e.g., wood, plastic).

Figure 3:
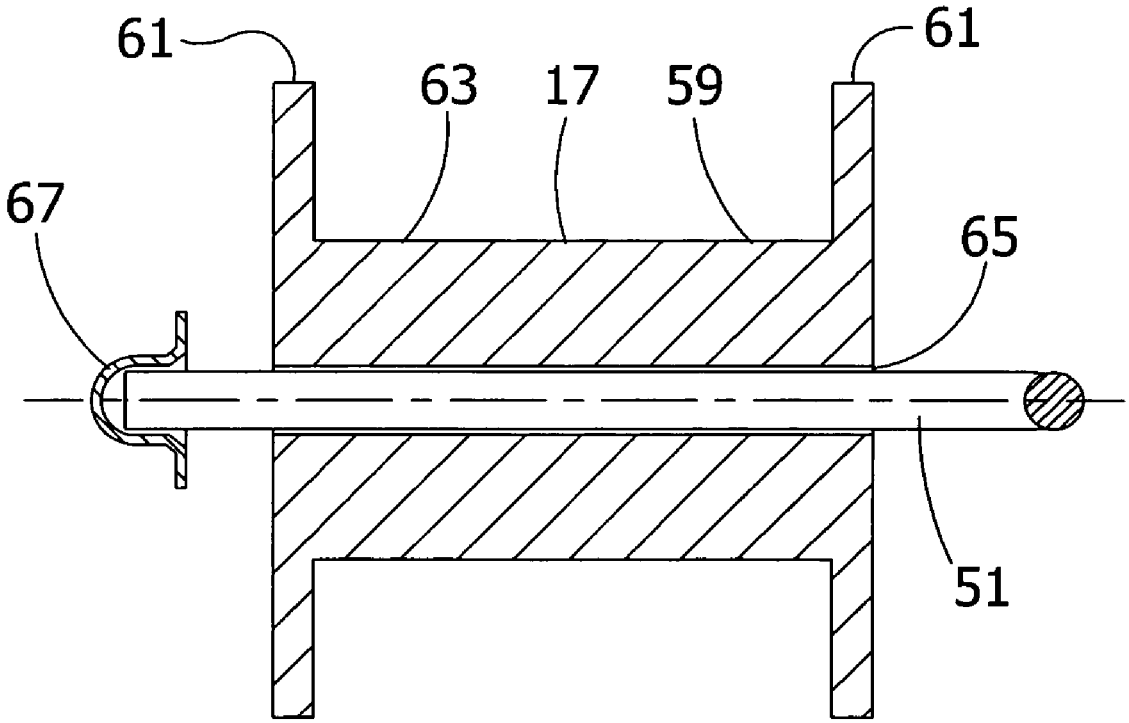
FIG. 3 is a section view of the pulley taken in the plane of line 3-3 of FIG. 2B.

Referring now to FIGS. 2B and 3, the pulley 17 comprises a cylinder 59 and two flanges 61 at the ends of the cylinder 59 for retaining the strap 19 on an outer surface 63 of the cylinder 59. The pulley 17 has a hole 65 passing longitudinally through its center, the hole 65 receiving the top 51 of the C-shaped portion 47 of the anchor 25. A compression fastener 67 is forced over the end of the top 51 of the C-shaped portion 47 to secure the pulley 17 on the anchor 25.

The pulley 17 is suitably made of a rigid material designed for repeated use (e.g., wood, metal, plastic). The flanges 61 on the pulley 17 have a diameter of about 4 inches. The cylinder 59 has a diameter of about 2 inches and is about 3.5-4 inches in length. The cylinder 59 may be concave, where the diameter tapers toward its center. The hole 65 in the center of the pulley 17 has a diameter of about 0.375 inches. The dimensions provided herein are for exemplary purposes only and it is understood that the pulley 17 can have other dimensions without departing from the scope of this invention.

Figure 4D:
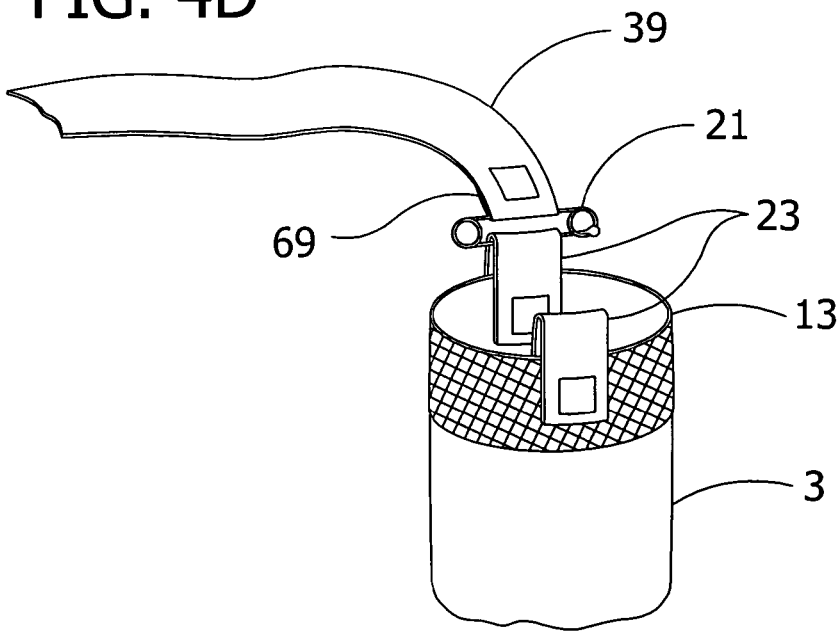
FIG. 4D is a perspective view showing the strap connected to one loop of the hosiery.

Referring now to FIGS. 4A-4D, the first end 39 of each strap portion 35, 37 has an eye 69 which receives one side of the locking fastener 21. The hosiery 3 has two loops 23 firmly attached adjacent to the open end 13, each loop 23 for receiving the other side of the locking fastener 21 attached to the first end 39 of one strap portion 35, 37. The locking fastener 21 of this configuration is shaped like a safety pin, but without the sharp point. The locking fastener 21 connects the first end 39 of one strap portion 35, 37 and hosiery loop 23 as shown in FIG. 4D.

The strap 19 is suitably about 0.75 inches wide and has a length of about 3-4 yards. The loop 23 is suitably made from material about 0.75 inches wide.

Figure 5A:
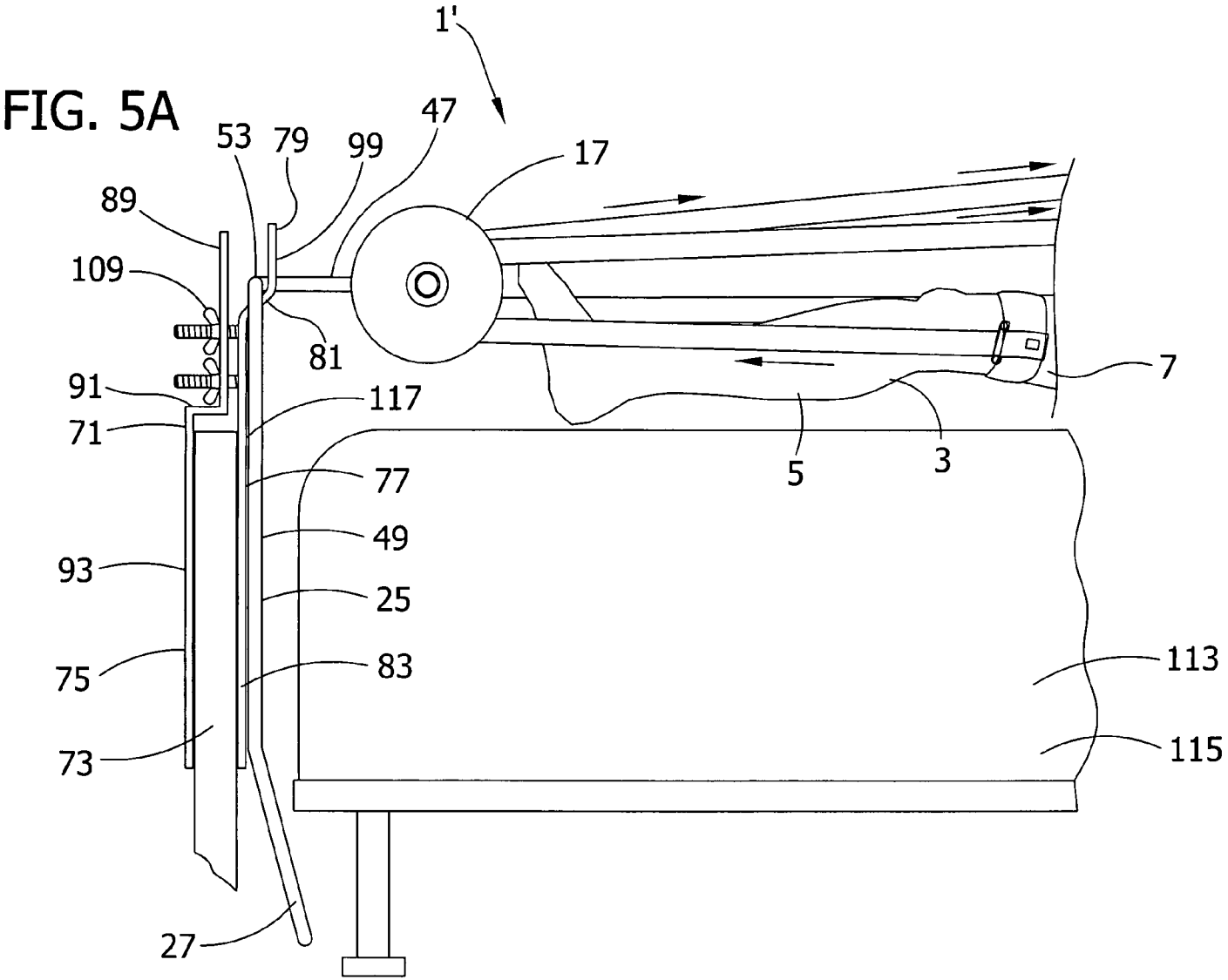
FIG. 5A is a side elevation of another configuration of the invention using an anchor support.
Figure 5C:
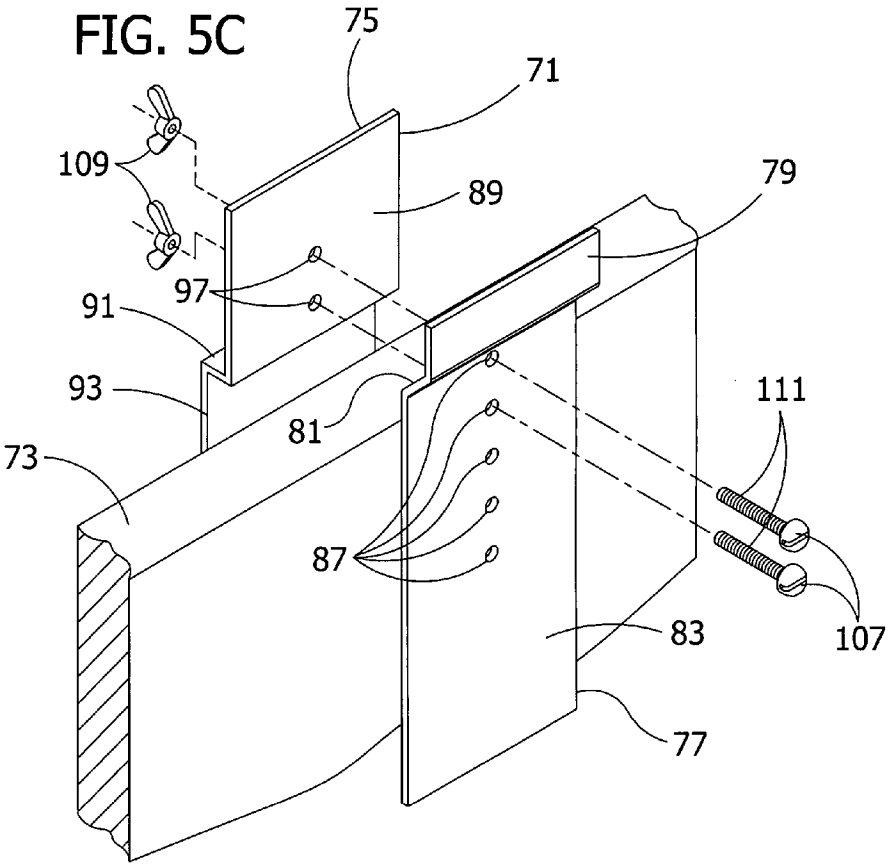
FIG. 5C is an exploded perspective view of the anchor support.
Figure 5B:
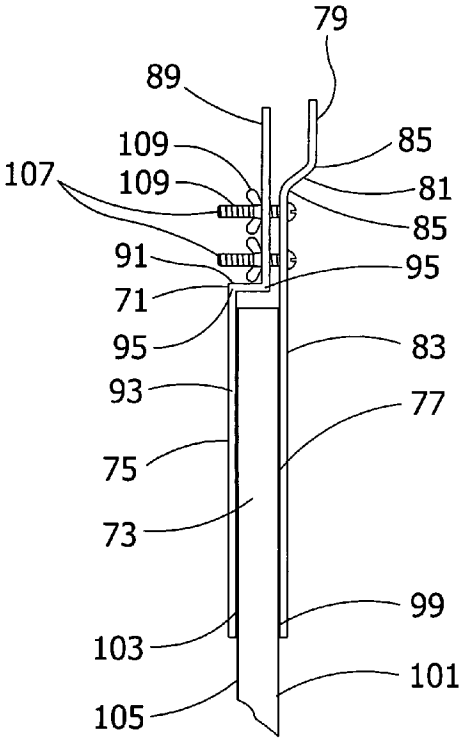
FIG. 5B is a fragmentary side elevation of the anchor support of FIG. 5A.

In another configuration shown in FIGS. 5A-5C, the apparatus 1' also comprises an anchor support 71 for attaching to a surface of a bed footboard 73 (broadly, a "stationary object"). The anchor support 71 comprises a backing plate 75 and a front plate 77. The front plate 77 has a top portion 79, an angled portion 81 and a bottom portion 83 defined by two bends 85 in the front plate 77. The two bends 85 are generally less than 90 degrees and are formed about an axis transverse to a longitudinal axis of the front plate 77. The top portion 79 is above the two bends 85, the angled portion 81 is between the two bends 85, and the bottom portion 83 is below the two bends 85. From a side view, the front plate 77 is generally S-shaped. As shown, the bottom portion 83 of the front plate 77 has five holes 87, but it is understood that the front plate 77 could have a different number of holes 87 without departing from the scope of the invention.

The backing plate 75 has a top portion 89, a middle portion 91, and a bottom portion 93 defined by two bends 95 in the backing plate 75. The two bends 95 are about 90 degrees and are centered about an axis transverse to a longitudinal axis of the backing plate 75. The top portion 89 is above the two bends 95, the middle portion 91 is between the two bends 95, and the bottom portion 93 is below the two bends 95. From a side view the backing plate 75 is generally S-shaped. The top portion 89 of the backing plate 75 has two holes 97.

The front plate 77 is suitably made from steel about 4 inches wide. The top portion 79 of the front plate 77 is about 1 inch long. The angled portion 81 of the front plate 77 is about 0.375 inches long. The first hole 87 in the bottom portion 83 is spaced about 0.5 inches from the angled portion 81. The rest of the holes 87 are spaced about 2 inches apart. The backing plate 75 is made from steel about 6 inches wide. The top portion 89 of the backing plate 75 is about 6.5 inches long. The middle portion 91 of the backing plate 75 is about 1.5 inches long. The bottom portion 93 of the backing plate 75 is about 8 inches long. The two holes 97 in the top portion 89 of the backing plate 75 are spaced about 2 inches apart. The dimensions provided herein are for exemplary purposes only and it is understood that the front plate 77 and the backing plate 75 can have other dimensions without departing from the scope of this invention. It is also understood that the front plate 77 and the backing plate 75 may be made from materials besides steel (e.g., wood, plastic).

Referring now to FIG. 5B, a back surface 99 of the front plate 77 is in contact with a front surface 101 of the footboard 73 and a front surface 103 of the backing plate 75 is in contact with a back surface 105 of the footboard 73. Two bolts 107 pass through corresponding holes 87, 97 on both the front plate 77 and the backing plate 75. A wingnut 109 engages the threads 111 of each bolt 107. The wingnuts 109 are tightened on the bolts 107 so that the front plate 77 and the backing plate 75 exert a force on the footboard 73, thus clamping the front plate 77 and the backing plate 75 to the footboard 73 as further described below. The bolts 107 are suitably about 0.125 inches in diameter, but it is understood the bolts 107 can have other dimensions without departing from the scope of the invention.

In the configuration shown in FIG. 5A, the front plate 77 and backing plate 75 are clamped to the bed footboard 73. The C-shaped portion 47 of the anchor 25 is positioned parallel to the floor. The bottom 53 of the C-shaped portion 47 of the anchor 25 is captured between the front plate 77 and backing plate 75, resting on the angled portion 81 of the front plate 77 and bearing on the back surface 99 of the top portion 79 of the front plate 77 when in use. The straight portion 49 of the anchor 25 with the hook 27 extends down along the front plate 77 towards the floor. Thus, the anchor 25 is removably secured to the anchor support 71 so that the hosiery wearer 7 may use the apparatus 1' while sitting in a bed 113 to remove the hosiery 3 from the leg 5 slightly elevated above a mattress 115 of the bed 113, as further described below.

Figure 6A:
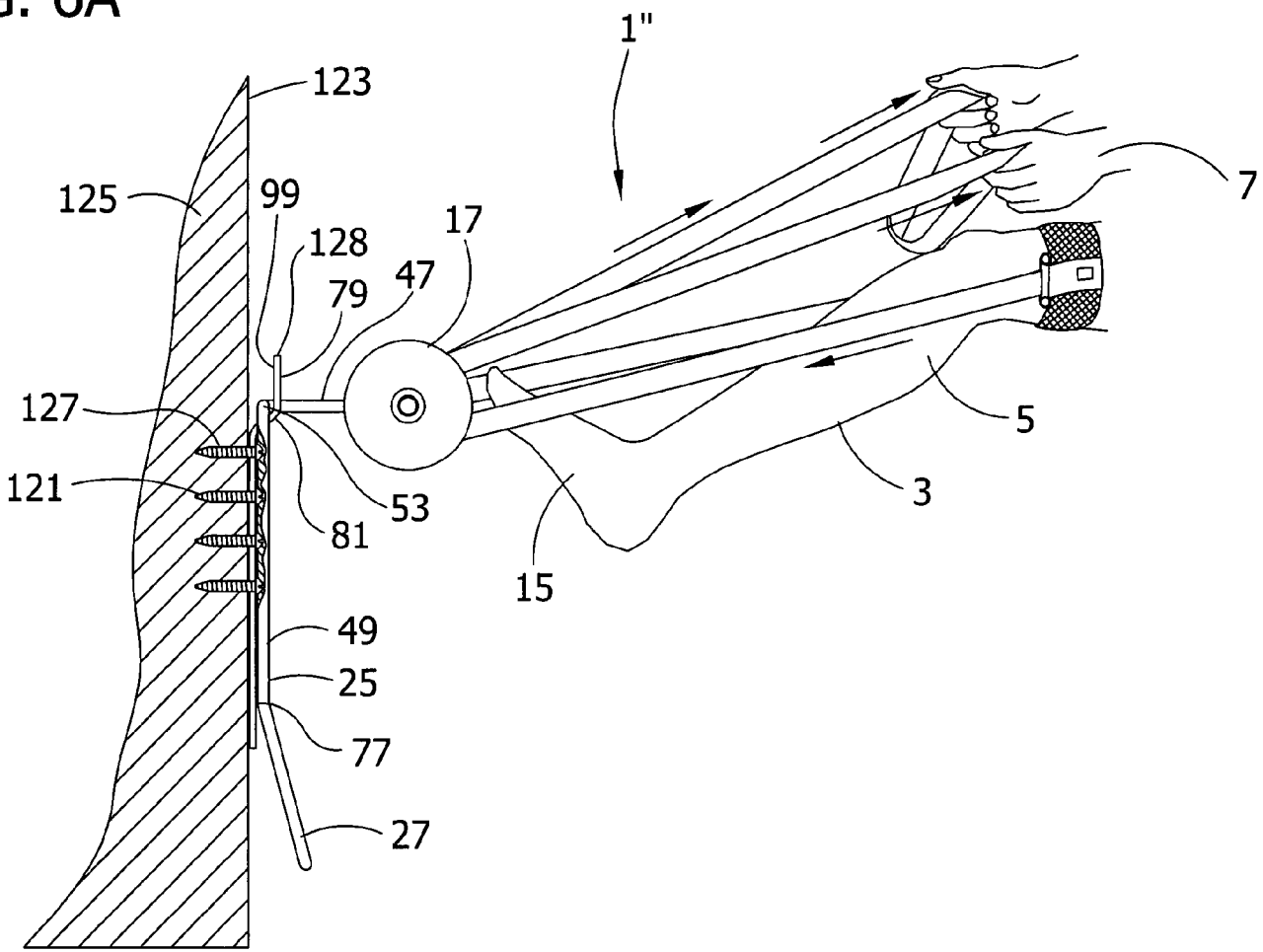
FIG. 6A is a partial section side elevation of another configuration of the invention.
Figure 6C:
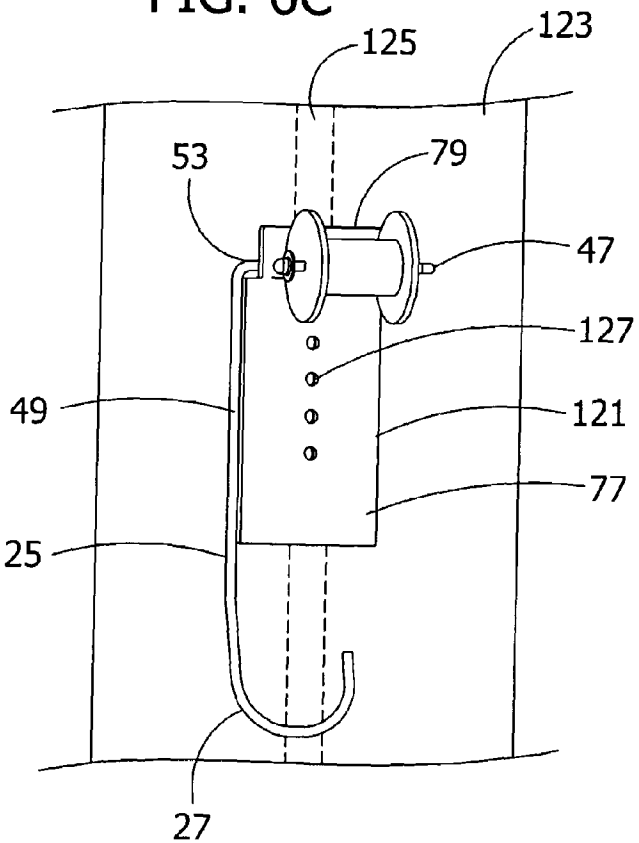
FIG. 6C is a perspective view similar to 6A, but showing the front plate of the anchor support secured to a wall stud, and the anchor resting on the support.
Figure 6B:
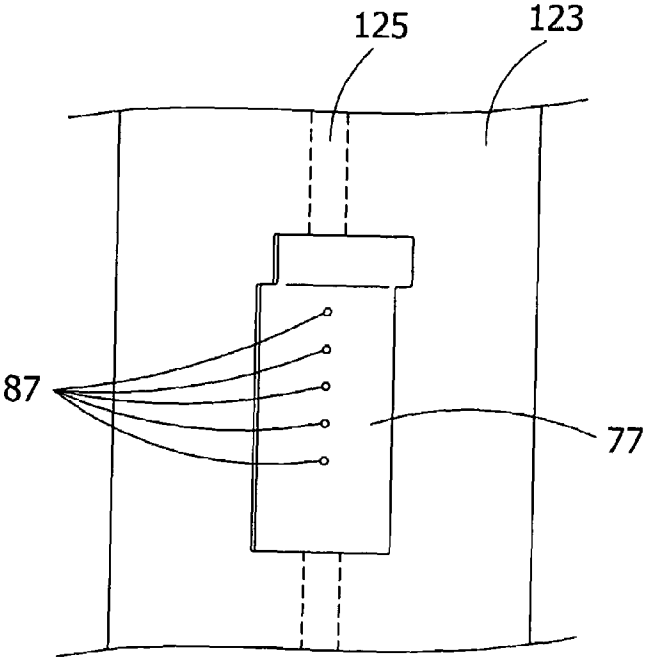
FIG. 6B is a perspective view of a front plate of the anchor support shown in FIG. 5A aligned with a wall stud.

In another configuration shown in FIGS. 6A-6C, the apparatus 1" also comprises an anchor support 121 for attaching to a surface of a wall 123 (broadly, "stationary object"). In this configuration the anchor support 121 comprises the front plate 77 shown in FIGS. 5A-5C. The front plate 77 is attached to a wall stud 125 with screws 127, a top edge 129 of the front plate 77 suitably being about 20 inches above the floor. The holes 87 in the front plate 77 are aligned with the wall stud 125 and the screws 127 secure the front plate 77 to the wall stud 125. The C-shaped portion 47 of the anchor 25 is positioned parallel to the floor. The bottom 53 of the C-shaped portion 47 of the anchor 25 is captured between the front plate 77 and wall 123, resting on the angled portion 81 of the front plate 77 and bearing on the back surface 99 of the top portion 79 of the front plate 77 when in use. The straight portion 49 with the hook 27 extends down along the front plate 77 towards the floor. Thus, the anchor 25 is removably secured to the anchor support 121 so that the hosiery wearer 7 may use the apparatus 1" while sitting in a chair (not shown) to remove the hosiery 3 from the leg 5, as further described below.

The following steps are performed in using the configuration of FIGS. 1-4D. The anchor 25 is secured by placing the hook 27 around the furniture leg 29. The wearer 7 sits in a chair (not shown) far enough from the pulley 17 so that when the wearer's leg 5 is extended the wearer's foot 15 does not touch the pulley 17. The wearer 7 folds the strap 19 in half so that the first end 39 of each strap portion 35, 37 are generally adjacent each other. The wearer 7 attaches the locking fastener 21 at the first end 39 of each strap portion 35, 37 to one of the loops 23 on opposite sides of the hosiery 3 adjacent the open end 13 of the hosiery 3. The wearer 7 uses the extension rod (not shown) for looping the strap 19 over the cylinder 59 of the pulley 17. The strap 19 is looped over the cylinder 59 by using the extension rod to position the second end 41 of each strap portion 35, 37 beneath the cylinder 59. Using the extension rod, the wearer 7 pulls the second end 41 of each strap portion 35, 37 over the top of the cylinder 59, until the wearer 7 can grasp at least a part of each of the first and second strap portions 35, 37 with hands 131 of the wearer 7. The wearer 7 applies a force to the strap 19 by manually pulling the second end 41 or handle 43 of the strap 19. The wearer 7 alternates the force between the first strap portion 35 and the second strap portion 37 in a seesaw manner. As the wearer 7 applies a force to the strap 19, the hosiery 3 is pulled off the wearer's leg 5. The hosiery 3 is inside out when it is pulled off the wearer's leg 5. When the open end 13 of the hosiery 3 gets to an ankle 133 of the wearer 7, the wearer 7 raises the leg 5 in the air and points toes 135 towards the pulley 17. The wearer 7 continues to apply force to the strap portions 35, 37 in a seesaw manner until the hosiery 3 is pulled off the wearer's foot 15. Once the hosiery 3 is free from the user, the hosiery 3 can be pulled past the pulley 17 using the strap 19 so that it can be grasped by the user. The user can then disconnect the hosiery 3 from the strap 19.

The following steps are performed in using the configuration of FIGS. 5A-5C. An installer installs the anchor support 71 by positioning the back surface 99 of the front plate 77 adjacent to the front surface 101 of the bed footboard 73, so that a front surface 117 of the front plate 77 faces the bed mattress 115. The installer positions the front surface 103 of the backing plate 75 adjacent to the back surface 105 of the bed footboard 73. The installer aligns the two holes 97 in the backing plate 75 with two of the holes 87 in the front plate 77. Depending on how high the installer wants the front plate 77 above the mattress 115, a different combination of the holes 87, 97 on the two plates 75, 77 may be used. The installer places the two bolts 107 through aligned holes 87, 97 of the front plate 77 and the backing plate 75. The wingnuts 109 are threaded on the bolts 107 and tightened so that the front plate 77 and the backing plate 75 clamp the footboard 73. The installer positions the bottom 53 of the C-shaped portion 47 of the anchor 25 so it is captured between the front plate 77 and the backing plate 75, resting it on the angled portion 81 of the front plate 77. The hook 27 at the end of the anchor 25 is pointed towards the floor. Once the anchor 25 and the pulley 17 are removably secured to the anchor support 71, the hosiery wearer 7 sits on the mattress 115 and uses the apparatus 1' as described in connection with the configuration shown in FIGS. 1-4D, except that the wearer 7 slightly elevates the leg 5 so that the hosiery 3 does not bind on the mattress 115. After the hosiery 3 is removed from the wearer's leg 5, the wearer 7 may either leave the anchor support 71 on the bed footboard 73 for future use or untighten the wingnuts 109 and remove the anchor support 71 from the footboard 73.

The following steps are performed in using the configuration of FIGS. 6A-6C. An installer installs the anchor support 121 by locating the wall stud 125 to screw the front plate 77 to. The installer aligns the holes 87 in the front plate 77 with the wall stud 125 and screws the front plate 77 into the wall stud 125. The installer positions the bottom 53 of the C-shaped portion 47 of the anchor 25 so it is captured between the front plate 77 and the wall 123, resting it on the angled portion 81 of the front plate 77. The hook 27 at the end of the anchor 25 is pointed towards the floor. Once the anchor 25 and the pulley 17 are removably secured to the anchor support 121, the hosiery wearer 7 sits down in the chair (not shown) far enough from the pulley 17 so that the wearer's foot 15 does not touch the pulley 17 when the wearer's leg 5 is fully extended towards the pulley 17. The wearer 7 uses the apparatus 1" as described in connection with the configuration shown in FIGS. 1-4D to remove the hosiery 3 from the wearer's leg 5.

When introducing elements of the present invention or the configuration(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products and methods without departing from the scope of the invention, it is intended that all matter contained in the above description or shown in the accompanying drawings shall be interpreted as illustrative and not in a limiting sense.

What is claimed is:

1. An apparatus for removing hosiery from a leg of a wearer, the hosiery including a tubular body with a foot end and an open end for receiving the wearer's foot and at least a portion of the wearer's leg, the apparatus comprising:

a sliding surface; and a flat strap engaging the sliding surface, the flat strap folded in half to define a first strap portion and a second strap portion such that first ends of each strap portion are generally adjacent each other, said first end of each strap portion having at least one connector affixed thereto, wherein the connectors are attached at opposite sides of the hosiery adjacent the open end of the hosiery, said flat strap including a second end where the flat strap forms a handle to be grasped by the wearer, the flat strap being free of objects along its length such that the flat strap can slide uninhibited over the sliding surface, wherein the wearer alternates an application of force to the first strap portion and the second strap portion of the grasped strap to pull the stocking off the leg of the wearer.

2. The apparatus as set forth in claim 1 wherein the strap has a length greater than about four times a length of the hosiery.

3. The apparatus as set forth in claim 2 wherein the strap is a single piece of material.

4. The apparatus as set forth in claim 3 wherein the strap is folded along a fold line extending transverse to a longitudinal axis of the strap, and wherein the strap portions are approximately equal in length.

5. The apparatus as set forth in claim 3 further comprising an anchor for holding the sliding surface.

6. The apparatus as set forth in claim 5 wherein the anchor includes a hook.

7. The apparatus as set forth in claim 5 further comprising an anchor support for attaching to a surface of a stationary object.

8. The apparatus as set forth in claim 1 wherein the sliding surface is defined by a pulley.

9. The apparatus as set forth in claim 1 wherein the strap has a generally rectangular cross-section.

10. The apparatus as set forth in claim 1 wherein the hosiery is a compression stocking.

11. An apparatus for removing hosiery from a leg of a wearer, said hosiery having a foot end and an open end for receiving the wearer's foot and at least a portion of the wearer's leg, said open end of the hosiery having two sides, the apparatus comprising:

an elongate strap folded in half to define a first strap portion and a second strap portion such that first ends of each strap portion are generally adjacent each other, said first end having at least a first connector for attaching the first strap portion to one side of the open end of the hosiery and at least a second connector for attaching the second strap portion to the opposite side of the open end of the hosiery, said strap further including a second end spaced from the first end, wherein the strap forms a loop defining a handle at the second end of the strap for grasping by the wearer; and a sliding surface slidingly engaged by the strap, the strap extending from the one side at the first end over the sliding surface to the second end, said strap further extending from the second end over the sliding surface to the other side at the first end, the strap being free of objects along its length such that the strap can slide uninhibited over the sliding surface, wherein the wearer alternates an application of force to the first strap portion and the second strap portion of the grasped strap to pull the stocking off the leg of the wearer.

12. The apparatus as set forth in claim 11 wherein the strap comprises a single piece of material, the strap being folded along a fold line extending transverse to a longitudinal axis of the strap, and wherein the strap portions are approximately equal in length.

13. The apparatus as set forth in claim 11 wherein at least a part of each of the first and second strap portions are available to be grasped by the wearer.

14. The apparatus as set forth in claim 11 wherein the hosiery is a compression stocking.

15. A method of removing hosiery from a leg of a wearer using an apparatus including an elongate strap having a first end and a second end, a remotely fixed sliding surface, and at least one connector located at the first end of the strap, comprising:

folding the strap in half to define a first strap portion and a second strap portion such that the first ends of each strap portion are generally adjacent each other, the first end of each strap portion having a connector affixed thereto;

attaching the connectors at opposite sides of the hosiery;

positioning the strap over the remotely fixed sliding surface such that a portion of the strap is positioned beneath the sliding surface and a portion of the strap is positioned over the sliding surface, wherein the strap engages the sliding surface at two locations spaced along its length between the first end and the second end of the strap;

grasping the second end of the strap; and alternating an application of force to the first strap portion and the second strap portion of the grasped strap to pull the stocking off the leg of the wearer.

16. The method as set forth in claim 15 wherein applying the force to the strap comprises the wearer manually pulling the strap.

* * * * *